United States Patent [19]

West

[11] 4,111,790

[45] Sep. 5, 1978

[54] DILUTION CHILLING DEWAXING SOLVENT

[75] Inventor: Theodore H. West, Sarnia, Canada

[73] Assignee: Exxon Research & Engineering Co., Linden, N.J.

[21] Appl. No.: 736,514

[22] Filed: Oct. 28, 1976

[51] Int. Cl.² ..... C10G 43/08

[52] U.S. Cl. ..... 208/33; 208/38

[58] Field of Search ..... 208/33

[56] References Cited

U.S. PATENT DOCUMENTS

| | | | |
|---|---|---|---|
| 1,978,010 | 10/1934 | Carlisle | 208/33 |
| 3,719,585 | 3/1973 | Brasher et al. | 208/33 |
| 3,871,991 | 3/1975 | Shaw | 208/33 |

*Primary Examiner*—Herbert Levine

*Attorney, Agent, or Firm*—Edward M. Corcoran; James H. Callwood

[57] ABSTRACT

An improvement in a dilution chilling dewaxing process wherein waxy lubricating oil stocks are solvent dewaxed by contacting them with successive increments of cold dewaxing solvent at a plurality of points along the height of a vertical tower divided into a plurality of stages while agitating the oil-solvent mixture in each stage to provide substantially instantaneous mixing of the waxy oil and solvent thereby precipitating wax from the oil while avoiding the well known shock chilling effect. The improvement resides in using as the dewaxing solvent, a mixture selected from the group consisting of (a) methylene chloride and (b) acetone, methylethyl ketone, methanol and mixtures thereof, and wherein the methylene chloride comprises at least about 20 LV% of the dewaxing solvent. This invention results in substantial energy savings, requires less solvent per volume of waxy oil feed and gives significant improvements in the filtration rate of the dewaxed oil over conventional autorefrigerant and/or ketone dewaxing solvents.

9 Claims, 4 Drawing Figures

FIGURE I

FEED FILTER RATE COMPARISON
FOR 25/75 Ac/Me AND 60/40 MEK/MIBK
DEWAXING SOLVENT

FEED: ARAB LIGHT 600 NEUTRAL

DEWAXING TEMP. −18°C

DEWAXED OIL FILTER RATE COMPARISON
FOR Di/Me, Ac/Me, AND MEK/Me
MEK/MIBK MEK/TOLUENE

FEED: ARAB LIGHT 600 NEUTRAL

DEWAXED OIL FILTER RATE COMPARISON
FOR MEK/ME AND MEK/MIBK
DEWAXING SOLVENTS

FEED: ARAB LIGHT 600 NEUTRAL
FILTER TEMP. -18°C

DILUTION CHILLING DEWAXING SOLVENT

BACKGROUND OF THE INVENTION

1. Field of the Invention

This invention relates to a process for solvent dewaxing waxy hydrocarbon oils. More particularly, this invention relates to an improved process for dilution chilling dewaxing waxy petroleum oil stocks in a staged chilling zone wherein cold dewaxing solvent is injected into said zone at a plurality of stages therealong and wherein the cold dewaxing solvent and the waxy oil are substantially instantaneously mixed in each stage as the waxy oil-solvent mixture passes from stage to stage, the improvement which comprises using a dewaxing solvent selected from the group consisting of a mixture of (a) methylene chloride and (b) acetone, methylethyl ketone, methanol and mixtures thereof, and wherein the methylene chloride comprises at least about 20 LV% of said solvent. This invention is particularly useful for dewaxing lubricating waxy oil stocks.

2. Description of the Prior Art

It is well known that wax-containing petroleum oil stocks can be dewaxed by shock chilling with a cold solvent. It is also known that shock chilling, in itself, results in a low filtration rate of the dewaxed oil from the resultant wax/oil-solvent slurry. Because of this, the conventional method of solvent dewaxing wax-containing petroleum oil stocks has been by cooling in scraped surface heat exchangers using an incremental solvent addition technique. In this technique, the dewaxing solvent is added at several points along the chilling apparatus. The waxy oil is chilled without solvent until some wax crystallization has occurred and the mixture is thickened considerably. The first increment of solvent is introduced at this point and cooling continues. Each incremental portion of solvent is added as necessary to maintain fluidity until the desired filtration temperature is reached at which point the remainder of the solvent required to obtain the proper viscosity of the mixture for filtration is added. In using this technique it is well known that the temperature of the incrementally added solvent should be the same as that of the main stream of oil at the point of addition to avoid the shock chilling effect. This process shall be hereinafter referred to as Conventional Incremental Dilution Dewaxing for the sake of brevity.

It is now well known that the adverse effects of shock chilling can be overcome by introducing the waxy oil into a staged chilling zone and passing the waxy oil from stage to stage of the zone, while at the same time injecting cold dewaxing solvent into a plurality of the stages and wherein a high degree of agitation is maintained in the stages so as to effect substantially instantaneous mixing of the waxy oil and solvent. As the waxy oil passes from stage to stage of the cooling zone, it is cooled to a temperature sufficiently low to precipitate wax therefrom without incurring the shock chilling effect. This produces a wax/oil-solvent slurry wherein the wax particles have a unique crystal structure which provides superior filtering characteristics such as high filtration rates of the dewaxed oil from the wax and high dewaxed oil yields. The basic concept of dilution chilling dewaxing referred to in this invention is disclosed in U.S. Pat. No. 3,773,650, the disclosures of which are incorporated herein by reference. This process shall hereinafter be referred to as DILCHILL for the sake of brevity.

A number of improvements and modifications have been made to the basic concept of DILCHILL. U.S. Pat. No. 3,642,609 shows that in a vertically staged cooling tower, the velocity of the solvent at the injection points within each stage should be at least 5–30 times that of the peripheral velocity of the mixer blades. This results in greater filtration rates and higher dewaxed oil yields than could otherwise be obtained without the relatively higher velocity solvent injection. In U.S. Pat. No. 3,775,288 is disclosed a combination of dilution chilling with scraped surface chilling for dewaxing lubricating oils. U.S. Pat. No. 3,681,230 discloses adjusting the dewaxing solvent composition so that the waxy oil and solvent are immiscible near the last stage of the cooling zone. This results in superior dewaxed oil yields and higher filter rates when the waxy oil stock being fed to the tower is relatively high in viscosity and molecular weight. U.S. Pat. No. 3,850,740 discloses partially prediluting the waxy oil when same is a relatively heavy feed, such as a resid, or a brightstock, before the oil is introduced into the chilling zone.

The use of ketones and mixtures thereof as well as mixtures of ketones and aromatic and/or aliphatic hydrocarbons in solvent dewaxing is as well known in the art as is the use of autorefrigerant solvents and halogenated solvents. The Di-Me solvent dewaxing and wax deoiling process is a commercially successful solvent dewaxing process employing a binary solvent mixture of dichloroethane and methylene chloride. Mixtures of ketones such as methylethyl ketone (MEK) and methyl isobutyl ketone (MIBK) as well as mixtures of ketones and aromatic hydrocarbons such as MEK/toluene are also well known and are used commercially all over the world, as are autorefrigerants and mixtures of autorefrigerants and ketones such as propylene and acetone. Although the use of mixtures of methylene chloride and other solvents for solvent dewaxing has been suggested many times in variouus patents and articles, such a combination has never met with any commercial or practical success other than the Di-Me process using mixtures of dichloroethane and methylene chloride.

One of the eariest disclosures on the use of methylene chloride may be found in U.S. Pat. No. 1,978,010 which is directed towards the use of methylene chloride alone or in admixture with other wax solvents such as acetone, butanol, benzol or naphtha for solvent dewaxing waxy oils. Another early disclosure on the possibility of dewaxing lubricating oils with methylene chloride alone or in admixture with a ketone dewaxing solvent may be found in an article by P. J. Carlisle and A. A. Levine entitled "Dewaxing Lubricating Oils with Methylene Chloride" in Vol. XXIV, No. 4 of Industrial and Engineering Chemistry (pages 384–387, 1932) wherein the use of methylene chloride alone and in admixture with acetone is disclosed as a potential dewaxing solvent. However, this did not meet with any commercial success and, on page 417 of their book entitled "Petroleum Refining with Chemicals" (Elsevier, Amsterdam, 1956), Kalichevsky and Kobe recite, in reference to the 1932 article by Carlisle and Levine, that in extracting a Pennsylvania lubricating oil fraction with a mixture containing 40% methylene chloride and 60% acetone, the filter rates were low. Kalichevsky and Kobe also stated that such solvents (mixtures of methylene chloride and acetone), when used for the liquid phase extraction (precipitation) of the wax, are not practical because of very high oil losses. Therefore, the prior art teaches a complete lack of success in solvent dewaxing using a dewaxing solvent comprising methylene chloride alone or in combination with other solvents, the one exception being the dichloroethane-methylene chloride mixture of the Di-Me process. Hence, with the exception of Di-Me, the art teaches away from the use of methylene chloride for solvent dewaxing.

SUMMARY OF THE INVENTION

Therefore, the instant invention was unexpected and opposite to the teachings of the prior art which is the discovery that the DILCHILL dilution chilling dewaxing processes as herein defined, supra, can be still further improved by employing a dewaxing solvent selected from the group consisting of a mixture of (a) methylene chloride and (b) acetone, methylethyl ketone (MEK), methanol and mixtures thereof. That is, in a process for dewaxing a waxy petroleum oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of the solvent-containing stages so as to achieve substantially instantaneous mixing of said waxy oil and said solvent while cooling said solvent-waxy oil mixture as it progresses from stage to stage through said chilling zone, thereby precipitating at least a portion of said wax from said oil under conditions of said high degree of agitation, separating the precipitated wax from the solvent-oil mixture and recovering a petroleum oil stock of reduced wax content from said mixture, the improvement which comprises using a cold dewaxing solvent selected from the group consisting of mixtures of (a) methylene chloride and (b) acetone, MEK, methanol and mixtures thereof, and wherein the methylene chloride comprises at least about 20 LV% of said solvent. Using the dewaxing solvent of the instant invention in the DILCHILL dewaxing process requires less total solvent for dewaxing than ketone and ketone/aromatic dewaxing solvents such as mixtures of MEK/MIBK and MEK/toluene, can provide increased dewaxed oil yields, results in increased filter rate of the dewaxed oil from the wax based on the waxy feed entering the chilling zone, thereby debottlenecking solvent dewaxing operations, and also reduces the amount of energy subsequently needed to recover the dewaxing solvent from the dewaxed oil and wax cake due to the lower latent heat of vaporization and lower boiling point of the methylene chloride. These advantages are not achieved if the dewaxing solvent of this invention is used in Conventional Incremental Dilution Dewaxing processes.

The methylene chloride content of the dewaxing solvent will range from about 20 to about 85 LV% of the solvent composition. The actual solvent composition used will depend on the nature of the oil being dewaxed and dewaxing conditions required. Typical solvent compositions are shown in Table I for three, widely used lube oil fractions. The solvent compositions shown in Table 1 have been found to be suitable for miscible solvent/oil dewaxing filtrations of the respective stocks shown for maintaining minimum wax solubility and maximum oil solubility in the dewaxing solvent.

Any waxy petroleum oil stock or distillate fraction thereof may be dewaxed with the process of this invention. In general, these oil stocks or distillate fractions will have a boiling range within the broad range of about 500° F to about 1300° F. The preferred oil stocks are the lubricating oil and specialty oil fractions boiling within the range of 550° F and 1200° F. However, residual waxy oil stocks and bright stocks having an initial boiling point of above about 800° F and containing at least about 10 wt.% of material boiling above about 1050° F may also be used in the process of the instant invention. These fractions may come from any source, such as the paraffinic crudes obtained from Aramco, Kuwait, the Pan Handle, North Louisiana, naphthenic crudes such as Coastal Crudes, Tia Juana, mixed crudes such as Mid-Continent, etc., as well as the relatively heavy feed stocks such as bright stocks having a boiling range of 1050° F.+ and synthetic feed stocks derived from Athabascar tar sands, etc.

DETAILED DESCRIPTION

Figure 1:
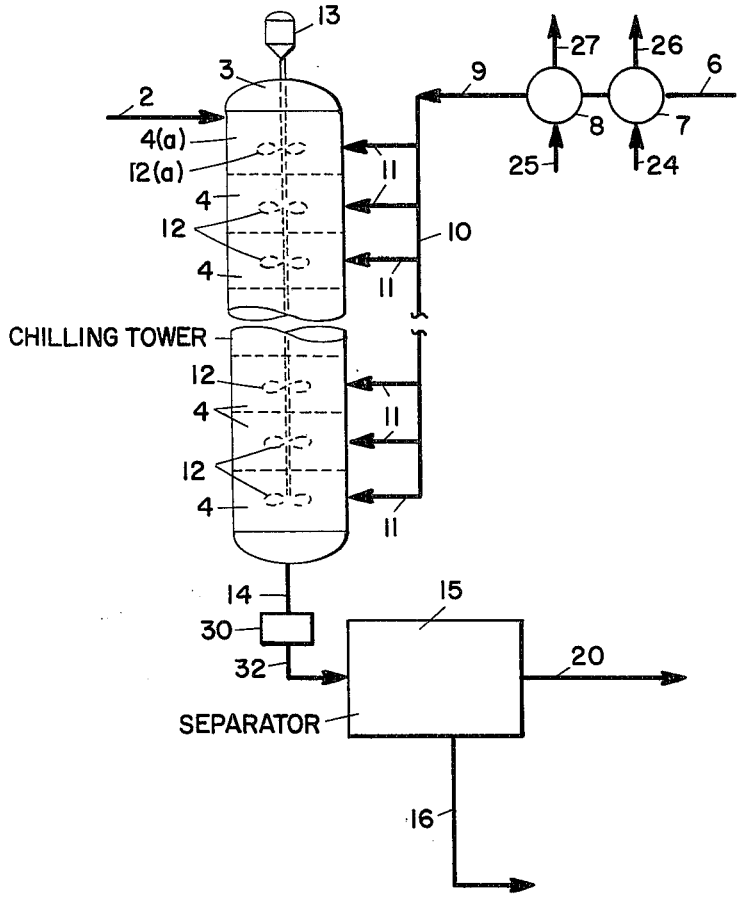
FIG. 1 is a flow diagram of a dilution chilling dewaxing process employed in the embodiment of the instant invention.
Figure 2:
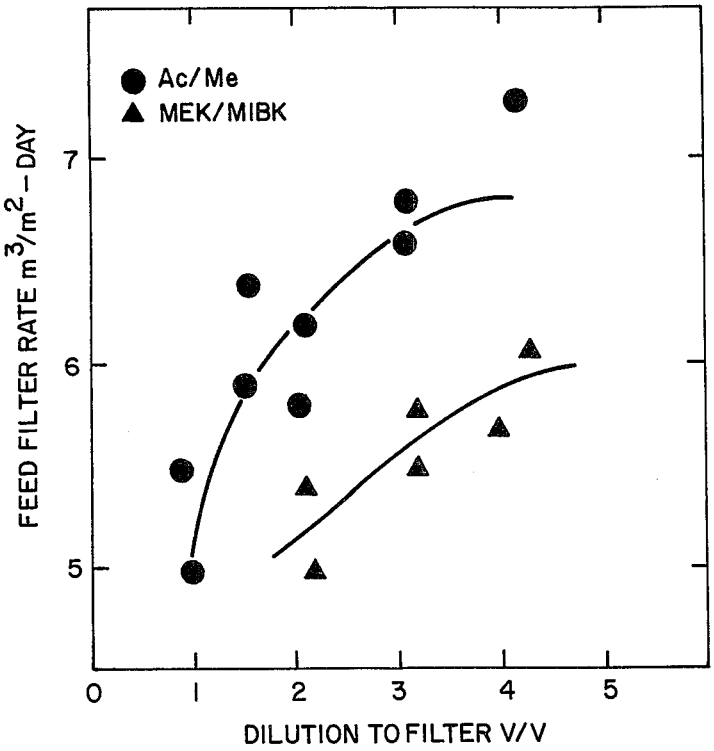
FIG. 2 is a graph of feed filter rate vs. solvent dilution to filter comparing an acetone/methylene chloride dewaxing solvent with an MEK/MIBK dewaxing solvent.
Figure 3:
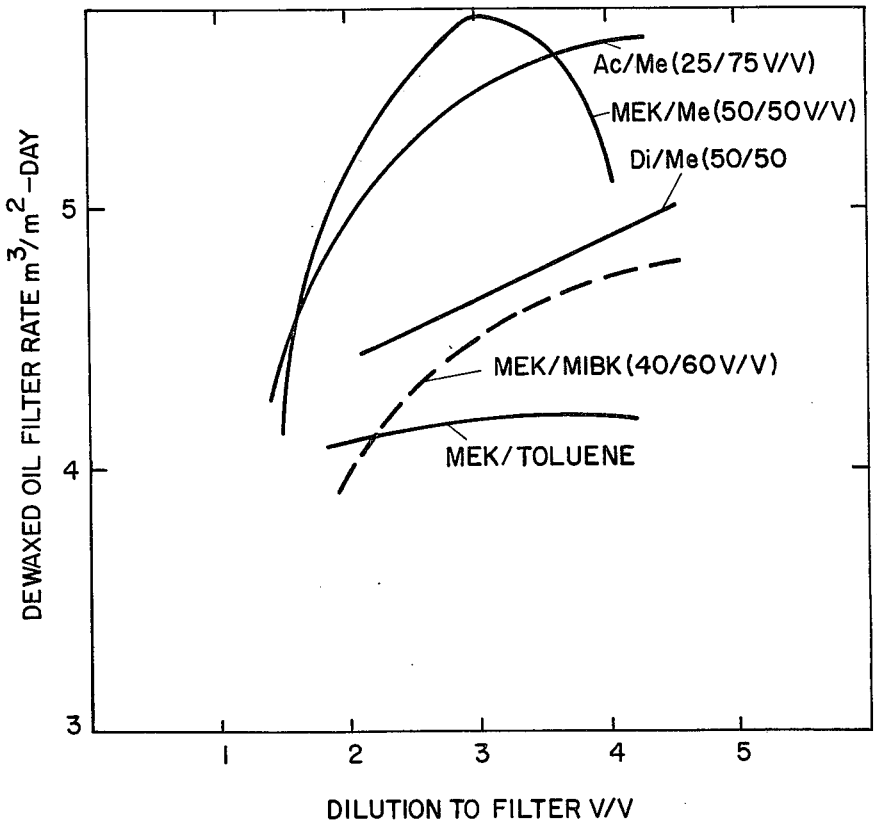
FIG. 3 illustrates the dewaxed oil filter rate of an acetone/methylene chloride and MEK/methylene chloride dewaxing solvents compared to MEK/MIBK, MEK/toluene and Di-Me dewaxing solvents.
Figure 4:
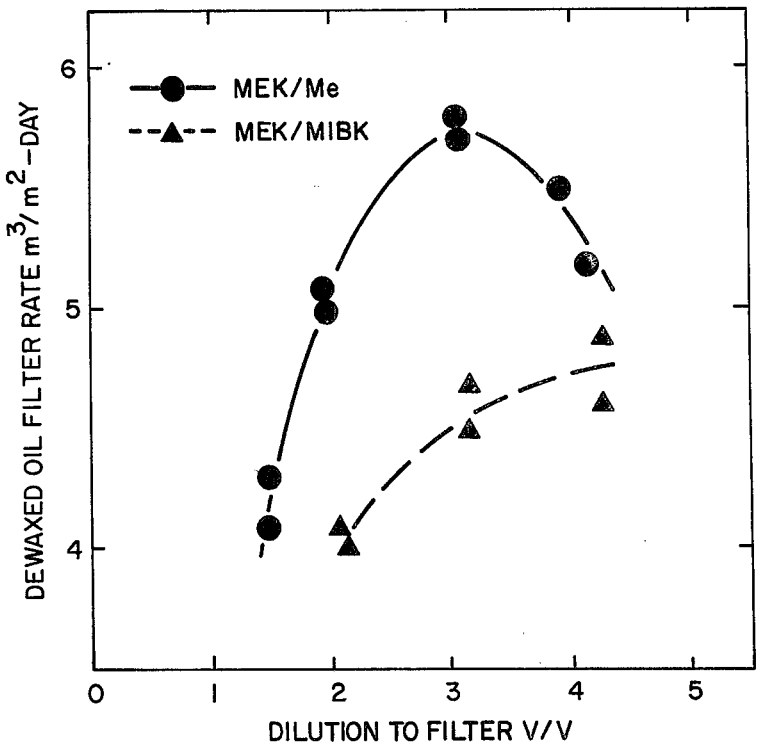
FIG. 4 illustrates dewaxed oil filter rate as a function of dilution to filter wherein the comparative solvent systems are MEK/methylene chloride and MEK/-MIBK.

Referring to FIG. 1, the oil stock to be dewaxed is passed into the top of vertical chilling tower 3 via line 2 wherein it enters the first stage of the chiller 4(*a*). An acetone/methylene chloride dewaxing solvent is passed through heat exchangers 7 and 8 via line 6 wherein the solvent temperature is reduced to a level sufficient to cool the oil to the desired dewaxing temperature. Coolant enters heat exchangers 7 and 8 through lines 24 and 25, respectively, and leaves through lines 26 and 27. Cold solvent leaves heat exchanger 8 via line 9 and enters manifold 10. The manifold comprises a series of parallel lines providing solvent inlets 11 to the plurality of stages 4 of chilling tower 3. The rate of flow through each inlet is regulated by flow control means (not shown). The rate of solvent flow is regulated so as to achieve the desired temperature profile distribution from stage to stage along the height of chilling tower 3. Preferably, the incremental solvent addition is such that the chilling rate of the oil is below about 10° F./minute and most preferably between about 1° and 5° F./minute. In general, the amount of solvent added thereto will be sufficient to provide a liquid/solid weight ratio between about 5/1 and 100/1 at the dewaxing temperature and a solvent/oil volume ratio between about 1.0/1 and 7/1.

The first portion or increment of cold dewaxing solvent enters first stage 4(*a*), of chilling tower 3 wherein it is substantially instantaneously mixed with the oil due to the action of agitator 12(*a*). The agitator is driven by a variable speed motor 13 and the degree of agitation is controlled by a variation of the motor speed with due allowance for the flow rate through the cooling tower. Although only downward flow of the oil-solvent mixture through chilling tower 3 has been shown, this mixture may also pass upwardly through the tower. Additional prechilled solvent is introduced into at least a portion of the plurality of stages 4, through inlets 11, so as to achieve the desired temperature distribution and total temperature drop in the tower and at the same time to provide the desired degree of dilution. It should be noted that any number of stages, for example 50, may be employed; however, it is desirable that at least six stages be used.

The oil-solvent mixture with precipitated wax passes from the final stage of the chilling tower through line 14 to scraped surface heat exchanger 30 wherein the oil-solvent mixture is additionally cooled via indirect heat exchange, thereby precipitating more wax from the oil-solvent mixture. The oil-solvent mixture with the precipitated wax passes from scraped surface exchanger 30 via line 32 to means 15 for separating the wax from the solvent-containing dewaxed oil solution. Any suitable means for such separation may be employed, such as filtration or centrifugation. In general, rotary vacuum or pressure filtration is a preferred means of separation. The dewaxed oil-solvent mixtures leave wax separation means 15 via line 20 and is sent to further processing such as solvent recovery to recover the solvent therefrom. The wax leaves separation zone 15 via line 16 and then passes through to solvent recovery operations and ultimately to additional wax refining operations.

An essential feature of the DILCHILL dewaxing process is the maintenance of a high degree of agitation in at least a portion of the stages during chilling in order to provide substantially instantaneous mixing of the waxy oil and solvent. By substantially instantaneous mixing is meant complete mixing of the oil-solvent mixture in one second or less. In this way, the deleterious effects of shock chilling are offset, the chilling rate is more readily controlled and increased filtration rates are obtained. The degree of agitation required in this invention can be achieved by increasing the agitator RPM when all of the mixing variables; e.g., flow rate through the mixer, vessel and agitator design, viscosity of the ingredients, etc., are maintained constant. In general, the degree of agitation required in this invention can be achieved when the modified Reynolds Number (Perry, "Chemical Engineers Handbook," 3rd, p. 1224, McGraw-Hill New York, 1959), $N_Re$, which is defined by the equation:

$$N_Re = L^2nl/\mu$$

where $L$ = agitator diameter, ft.
$l$ = liquid density, lb/ft.$^3$
$n$ = agitator speed, r.p.s.
$\mu$ = liquid viscosity, lb./ft. sec.

is between about 200 and about 150,000.

The dimensionless ratio of cooling tower diameter to agitator diameter is generally between about 1.5/1 and about 10/1, and the ratio of the impeller blade length to impeller blade width ranges from about 0.75 to 2 and preferably from about 1 to 1.5. The ratio of the mixing stage height to the diameter of the stage will generally range from about 0.2/1 to 1/1. A turbine type of agitator is preferred; however, other types of agitators such as propeller agitators may be used.

The cooling tower may or may not be baffled, but a baffle tower is greatly preferred. Each stage will generally contain from about 2 to 8 baffles and preferably from 2 to 4 baffles, located about the outer periphery of each stage. The width of the baffles may vary from about 5 to 15% of the diameter of the tower. In general, the dimensionless ratio of the cross-section of the restricted flow opening to the cross-section of the tower will be between about 1/20 and about 1/200. Further, the cooling tower will be operated at a pressure sufficient to prevent flashing of the solvent. Atmospheric pressure is sufficient when using the dewaxing solvent of the present invention.

PREFERRED EMBODIMENT

The invention will be more apparent from the working examples set forth below.

EXAMPLE 1

In this example, experiments were run utilizing a single stage dilution chilling dewaxing laboratory batch unit which, while not completely duplicating continuous multistage operation, has been found to give results approximately equivalent to those obtained with continuous, commercial multistage operations. The unit contained a flat-bladed propeller and a solvent injection tube with a recycle loop. Experiments were conducted by filling the unit with the waxy oil to be chilled at just above its cloud point. After the unit was filled with the waxy oil, the impeller was started along with simultaneous injection of chilled solvent into the waxy oil at the impeller tip. The solvent was injected continuously, but at incrementally increased flow rates for a total of 17 successive incremental increases in flow rate in order to simulate a 17 stage dilution chilling dewaxing tower. Following the addition of the desired volume of cold dewaxing solvent the slurry from the unit was then scrape surface chilled at an average rate of about 2° F per minute until a filtration temperature of 20° F was reached. The filter rate and the waxy oil yield as well as the wax cake liquid/solid ratio were determined by filtering the cold, diluted waxy slurry through a laboratory filter leaf calibrated to simulate a rotary filter operation, followed by washing the wax cake on the filter with additional dewaxing solvent at the filtration temperature.

Two dewaxing solvents were used in this example. One was a 45/55 LV% mixture of MEK/MIBK and the other was a 30/70 LV% mixture of acetone/methylene chloride, the solvents being precooled to −20° F. The waxy oil feed was a phenol raffinate of a vacuum distillate cut from a paraffinic, Western Canadian Leduc blend crude oil having an initial pour point of about 130° F., a viscosity of 66.7 SUS at 210° F. with a V.I. of 90. The waxy oil added to the unit was at a temperature of about 135° F. The volumetric ratio of dewaxing solvent to the feed, the volumetric ratio of the wash solvent (wax cake) to the feed, total solvent used, feed filter rate and wax oil content are shown in Table II. Approximately 21% of the oily feed was removed as wax in each case. These data show that the acetone/methylene chloride dewaxing solvent resulted in a much greater feed filter rate using significantly less solvent.

EXAMPLE 2

This example was similar to Example 1 except that the waxy oil feed was a phenol raffinate of an Aramco 600 Neutral oil having a V.I. of 95, a viscosity at 210° F. and 100° F. of 67.7 and 596 SUS, respectively, a pour point of −15° C., an API gravity of 27. The waxy oil added to the unit was at a temperature of 126° F. The dewaxing solvents used in this example were a 40/60 LV% ratio of MEK/MIBK, a 70/30 LV% mixture of MEK/toluene and a 20/80 LV% of acetone/methylene chloride, all precooled to −20° F. The results are shown in Table III and illustrate that the acetone/-methylene chloride was superior to both the MEK/-MIBK and MEK/toluene dewaxing solvents in that less solvent was used, the feed filter rate was greater and the wax had a lower oil content.

EXAMPLE 3

This experiment was run to compare DILCHILL with Conventional Incremental Dilution Dewaxing employing the dewaxing solvent of the instant invention and used the same feed and dewaxing method as in Example 2 for the DILCHILL dewaxing, except that both acetone/methylene chloride and MEK/methylene chloride dewaxing solvents were compared to an MEK/toluene dewaxing solvent. For the Conventional Incremental Dilution Dewaxing runs, an elongated, horizontal, scraped-surface chiller was used to chill the waxy oil passing therethrough at a rate of about 6° F. per minute. The first increment of solvent was added at 95° F., the second at 59° F. and the final increment was added at the filtration temperature of 5° F.

The data for all of the runs are listed in Table IV and clearly show that both the acetone/methylene chloride and MEK/methylene chloride solvents give a 20% increase in dewaxed oil filter rate in DILCHILL dewaxing, but not in Conventional Incremental Dilution Dewaxing.

TABLE 1

SPECIFIC SOLVENT COMPOSITIONS FOR DEWAXING WAXY STOCKS

| Oil Stock[a] | Ac/Me v/v[b] | MEK/Me v/v[c] |
|---|---|---|
| 150 Neutral | 40/60 | 70/30 |
| 600 Neutral | 25/75 | 50/50 |
| 2500 Bright Stock | 15/85 | 40/60 |

[a]Numbers refer to SUS viscosity at 100° F.
[b]Ac/Me - acetone/methylene chloride.
[c]MEK/Me - MEK/methylene chloride.

TABLE 2

| Feed: Sarnia 600 Neutral | | | Dewaxed Oil Properties | |
|---|---|---|---|---|
| | | | V 100° F | 597 SUS |
| | | | V 210° F | 66.7 SUS |
| | | | VI | 90 |
| | | | API Gr | 29 |
| | | | Pour ° C | −6 |
| | | | % Wax Removed | 21 |
| Dewaxing Solvent System | MEK/MIBK 45/55 V/V | | Acetone/Methylene Chloride 30/70 V/V | |
| Dilution S/F, V/V | 3.2 | 2.1 | 1.7 | |
| Wash S/F, V/V | 2.3 | 0.9 | 0.9 | |
| Total Solvent | 5.5 | 3.0 | 2.6 | |
| Feed Filter Rate, $m^3/m^2D$ | 7.2 | 6.9 | 8.5 | |
| Wax Oil Content Wt. % | 10 | 22 | 15 | |

TABLE 3

| Feed: Aramco 600 Neutral | | | Dewaxed Oil Properties | |
|---|---|---|---|---|
| | | | V 100° F | 596 |
| | | | V 210° F | 67.7 |
| | | | VI | 95 |
| | | | API Gr | 27 |
| | | | Pour ° C | −15 |
| | | | % Wax Removed | 17 |
| Dewaxing Solvent System | MEK/MIBK 40/60 V/V | MEK/Toluene 70/30 VIV | Acetone/Methylene Chloride 20/80 V/V | |
| Dilution S/F, V/V | 3.2 | 3.2 | 1.5 | 2.0 |
| Wash S/F, V/V | 1.4 | 1.2 | 1.2 | 1.5 |
| Total Solvent | 4.6 | 4.4 | 2.7 | 3.5 |
| Feed Filter Rate, $m^3/m^2D$ | 5.3 | 5.4 | 6.1 | 6.8 |
| Wax Oil Content Wt. % | 16.5 | 19.5 | 13 | 11 |
| Filter Temp. ° C | −15 | −20.6 | −15 | −15 |
| Pour ° C | −14 | −14 | −11.5 | −8 |

TABLE 4

COMPARISON OF MEK/TOLUENE, ACETONE/METHYLENE CHLORIDE (Ac/Me) AND MEK/METHYLENE CHLORIDE (MEK/ME) IN CONVENTIONAL AND DILCHILL DEWAXING)

Feed: Arab Light 600 Neutral
Boiling Range ~ 400-600° C

| | Conventional Incremental Dilution | | | DILCHILL | | |
|---|---|---|---|---|---|---|
| Solvent Composition v/v | MEK/Toluene 70/30 | Ac/Me 25/75 V/V | MEK/Me 50/50 V/V | MEK/Toluene 70/30 | Ac/Me 25/75 V/V | MEK/Me 50/50 V/V |
| Total Dilution | 3.0 | 2.0 | 2.0 | 3.0 | 2.0 | 2.0 |
| Relative Dewaxed[a] Oil Filter Rate | 1.0 | 0.98 | 1.0 | 1.4 | 1.7 | 1.7 |
| % Oil in Wax | 17 | 23 | 22 | 15 | 13 | 22 |
| Dewaxed Oil Yield | 80.3 | 78.9 | 79 | 80.4 | 80.6 | 79 |

Note:
(a)Filter rate divided by filter rate for MEK/Toluene in Conventional Dilution Chilling Dewaxing.

What is claimed is:

1. In a process for dewaxing a waxy petroleum oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of solvent-containing stages so as to achieve substantially instantaneous mixing of said waxy oil and said solvent-waxy oil mixture as it progresses from stage to stage through said chilling zone, thereby precipitating at least a portion of said wax from said oil under conditions of said high degree of agitation separating the precipitated wax from the solvent-oil mixture and recovering an oil stock of reduced wax content from said mixture, the improvement which comprises using as said cold dewaxing solvent, a solvent selected from the group consisting of mixtures of (a) methylene chloride and (b) acetone, MEK, methanol and mixtures thereof and wherein the amount of methylene chloride in said dewaxing solvent is at least about 20 LV %.

2. The process of claim 2 wherein the amount of methylene chloride in said solvent ranges from 20 to 85 LV%.

3. The process of claim 2 wherein said chilling zone is divided into at least six agitated stages.

4. The process of claim 3 wherein said solvent oil mixture is cooled in said chilling zone at an average rate of from about 1° to about 5° F. per minute.

5. The process of claim 4 wherein said waxy oil stock is a lube oil fraction.

6. The process of claim 5 wherein said waxy lube oil is introduced into said chilling zone at a temperature above its cloud point.

7. The process of claim 6 wherein said solvent is selected from the group consisting of a mixture of (a) methylene chloride and (b) acetone or MEK.

8. The process of claim 7 wherein the cold dewaxing solvent is a mixture of MEK and methylene chloride and is added to the said chilling zone in an amount such that the dilution ratio of the wax/solvent-dewaxed oil slurry ranges from about 1.75 to about 4 volumes per volume of dewaxed oil.

9. The process of claim 7 wherein the cold dewaxing solvent is a mixture of acetone and methylene chloride and is added to the chilling zone in an amount such that the dilution ratio of the wax/solvent-dewaxed oil slurry is at least about 1.75 volumes per volume of dewaxed oil.

* * * * *